US007261589B2

(12) United States Patent
Gillespie et al.

(10) Patent No.: US 7,261,589 B2
(45) Date of Patent: Aug. 28, 2007

(54) CONNECTOR FOR FLEXIBLE PRINTED CIRCUIT

(75) Inventors: Brian Gillespie, Harrisburg, PA (US); Kevin E. Walker, Hershey, PA (US); Tod M. Harlan, Mechanicsburg, PA (US); Robert W. Brown, Harrisburg, PA (US); Joanne E. Shipe, Harrisburg, PA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/267,808

(22) Filed: Nov. 4, 2005

(65) Prior Publication Data

US 2007/0105423 A1 May 10, 2007

(51) Int. Cl.
*H01R 12/24* (2006.01)

(52) U.S. Cl. ..... 439/495; 439/260

(58) Field of Classification Search ..... 439/495, 439/260, 329, 499, 267, 67, 372, 142, 341, 439/596, 409
See application file for complete search history.

(56) References Cited

U.S. PATENT DOCUMENTS 6,099,346 A 8/2000 Hashiguchi et al.
6,431,897 B1 * 8/2002 Hashiguchi et al. ..... 439/267
6,755,682 B2 6/2004 Kunishi et al.
6,893,288 B2 5/2005 Tsunematsu
7,189,104 B1 * 3/2007 Gillespie et al. ..... 439/495
2004/0147159 A1 * 7/2004 Urban et al. ..... 439/409
2005/0260885 A1 * 11/2005 Lu ..... 439/495

* cited by examiner

*Primary Examiner*—Felix O. Figueroa
(74) *Attorney, Agent, or Firm*—Wei Te Chung

(57) ABSTRACT

An electrical connector for connecting a sheet-like member includes a housing (1) defining an insertion slot (10); a plurality of terminals (2) arranged in the housing in parallel relationship with a predetermined pitch, each of the terminals having a contact beam (22) extending into the insertion slot and a pivot beam (21) extending substantially parallel to the contact beam; and an actuator (3) rotatably provided for establishing an electrical connection between the sheet-like member and the contact beams. The actuator provides cam portions (31) each interposed between every other the pivot beam. Each of the cam portions provides shaft portions (32) respectively adapted for pivotably engaging with the pivot beams disposed therebeside. The shaft portions extending towards each other respectively from two adjacent cam portions are spaced to define a gap (33) therebetween.

18 Claims, 12 Drawing Sheets

CONNECTOR FOR FLEXIBLE PRINTED CIRCUIT

BACKGROUND OF THE INVENTION

1. Field of the Invention

The present invention relates to an electrical connector, and more particularly to an electrical connector for a sheet-like connection member such as a flexible printed circuit or cable (FPC), a flexible flat cable (FFC) and so forth. All of these cables and circuit hereafter will be generally referred to as "FPC" for simplification.

2. Description of Related Art

A conventional FPC connector generally includes a plurality of terminals each comprising a contact beam provided with a contact portion adapted for contacting an FPC and a pivot beam extending substantially parallel to and opposed to the contact beam, a housing adapted for holding the terminals and comprising opposite lower and upper walls defining a cavity therebetween wherein the lower wall protruding forwardly beyond the upper wall along a horizontal direction, and a pivoting actuator pivotably assembled on free ends of the pivot beams. The terminals are arranged in the housing in a side-by-side fashion, and each terminal has the contact beam thereof fixed in the lower wall of the housing and has the pivot beam thereof partly fixed in the upper wall of the housing, that is, the rear section of the pivot beam fixed in the upper wall and the front section of the pivot beam projected beyond the upper wall as a cantilever with no support. The front section of the pivot beam is provided with a concave portion for engaging with the actuator. The actuator is provided with cam portions disposed between every two adjacent pivot beams and shaft portions located between and joining every two adjacent cam portions. The shaft portions are respectively pivotably received in the concave portions of the pivot beams. Via engagement of the shaft portions of the actuator and the pivot beams of the terminals, the actuator is pivotable between an open position where an FPC can be inserted into the housing with zero-insertion-force and a closed position where the FPC is urged by the cam portions so as to connect with the contact portions of the contact beams. Such kind of FPC connectors can be found in U.S. Pat. Nos. 6,893,288, 6,755,682 and 6,099,346.

However, the front sections of the pivot beams projected as cantilevers without any support are relatively weaker and apt to deform during assembly and operation of the actuator. Otherwise, the shaft portions each disposed between and joining two cam portions are breakable especially once being inadvertently struck during operation of the actuator. Therefore, it is desired to have a new FPC connector in which pivot beams are well supported and thereby are well strengthened.

SUMMARY OF THE INVENTION

An object of the present invention is to provide a new FPC connector in which pivot beams of terminals are strengthened.

In order to achieve above-mentioned object, an FPC connector for connecting an FPC in accordance with the preferred embodiment of the present invention includes a housing defining an insertion slot for receiving the FPC; a plurality of terminals arranged in the housing in parallel relationship with a predetermined pitch, each of the terminals having a contact beam extending into the insertion slot and a pivot beam extending substantially parallel to the contact beam; and an actuator rotatably provided for establishing an electrical connection between the sheet-like member and the contact beams. The actuator provides cam portions each interposed between every other the pivot beam. Each of the cam portions provides shaft portions respectively adapted for pivotably engaging with the pivot beams disposed therebeside. The shaft portions extending towards each other respectively from two adjacent cam portions are spaced to define a gap therebetween.

Other objects, advantages and novel features of the present invention will become more apparent from the following detailed description of the present embodiment when taken in conjunction with the accompanying drawings.

DETAILED DESCRIPTION OF THE INVENTION

The present invention will be discussed hereafter in detail in terms of the embodiments of the present invention. However, any well-known structure or feature is not shown in detail in order to avoid unnecessary obscurity of the present invention.

Figure 1:
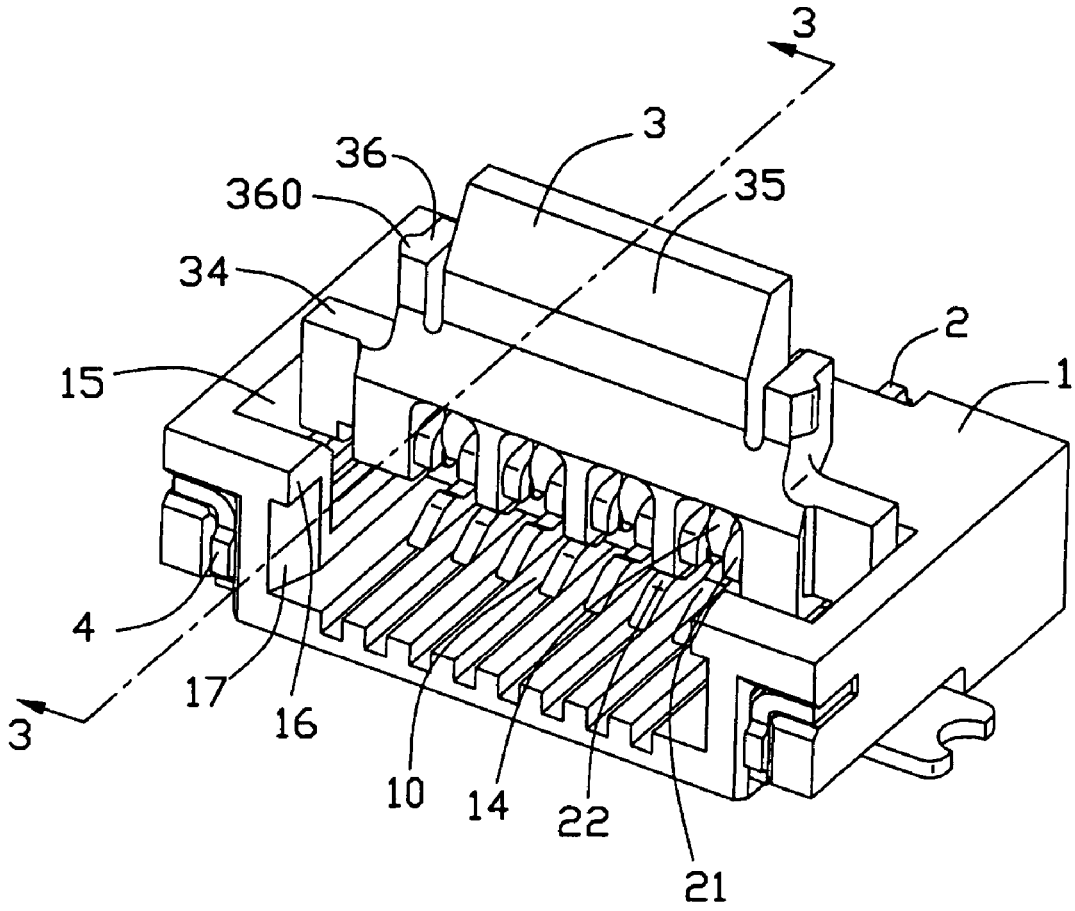
FIG. 1 is an assembled perspective view of an FPC connector in accordance with a first embodiment of the present invention.
Figure 2:
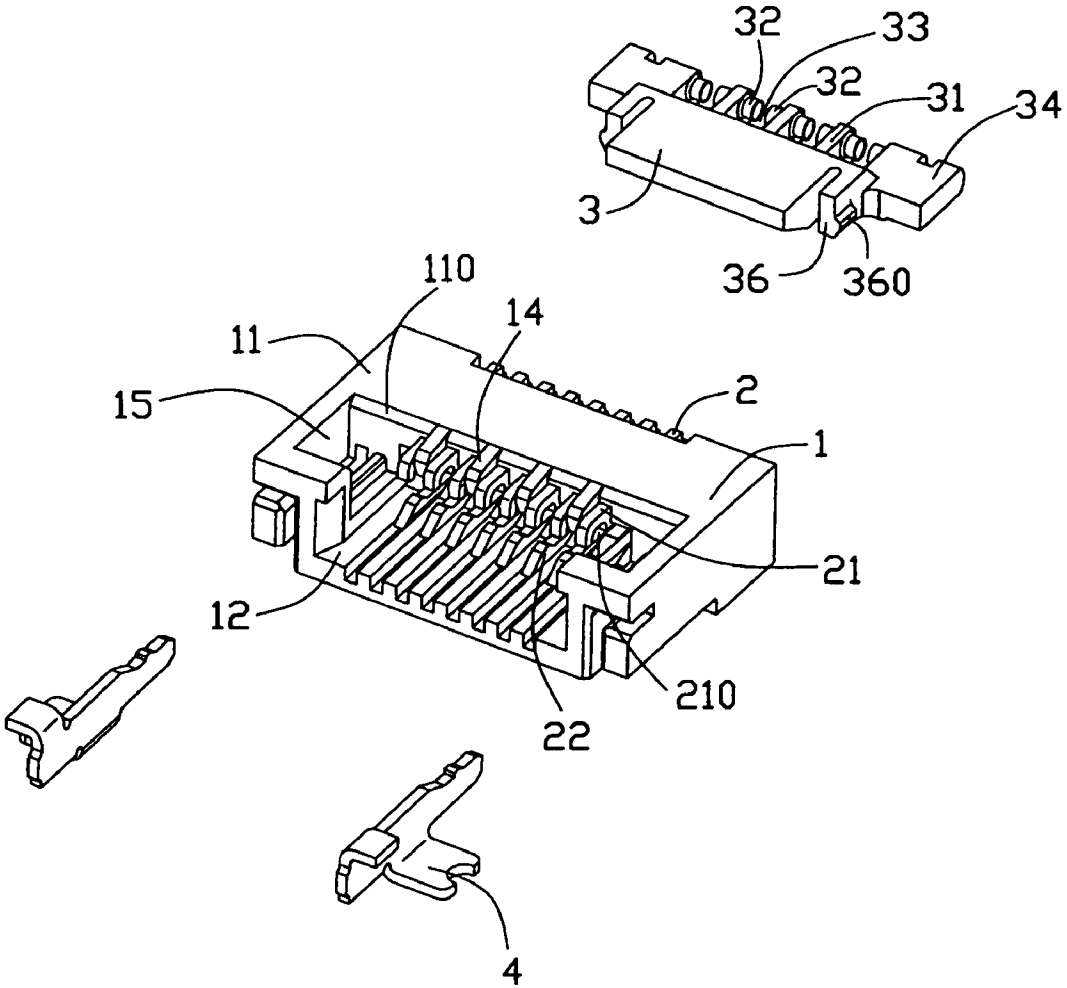
FIG. 2 is a partly exploded perspective view of the FPC connector shown in FIG. 1, wherein an actuator and a pair of support members are disassembled from a housing, but terminals are still assembled in the housing.

Referring to FIGS. 1-3, description will be made as an FPC connector according to the first embodiment of the present invention. The FPC connector comprises an insulative housing 1, a plurality of terminals 2, an actuator 3, and a pair of support members 4. The FPC connector is provided with an FPC insertion slot 10 at the front portion thereof. A lower portion of the FPC insertion slot 10 is provided by a bottom wall 12 of the housing 1, and an upper portion of the FPC insertion slot 10 is designed to be opened and closed by the actuator 3.

The terminals 2 are arranged in side-by-side relationship with a predetermined pitch from a rear side of the housing 1. Each terminal 2 has a contact beam 22 and a pivot beam 21 parallel extending forwards from a base portion 20 and a solder foot 23 extending rearwards from the base portion 20. Upon being installed in the housing 1, the contact beam 22 extends along the bottom wall 12 in the lower portion of the FPC inserting slot 10. The pivot beam 21 extends along an upper wall 11 of the housing 1 and has a front section thereof projecting beyond the front edge 110 of the upper wall 11. The front section of the pivot beam 21 defines a concave portion 210 on the lower edge at the tip end thereof.

There are finger portions 14 integrally projecting from the upper wall 11 of the housing 1 and each interposed between every other pivot beam 21 so as to laterally support the front sections of the pivot beams 21 therebeside. Otherwise, the actuator 3 is formed with a plurality of wedge portions 31 operable as cam portions adapted for pushing the FPC to firmly connect with the contact beams, each interposed between every other pivot beam 21 without the finger portion 14 interposed therebetween. Thus spaces between the pivot beams 21 of every two adjacent terminals 2 arranged side-by-side are alternately interposed with the finger portions 14 formed on the housing 1 and the cam portions 31 formed on the actuator 3.

Additionally, in order to engage with the concave portions of the pivot beams, the actuator 3 provides shaft portions 32 at two sides of each cam portion 31. The shaft portions 32 extending from different cam portions 31 align with each other along a longitudinal direction of the actuator 3, wherein the shaft portions 32 extending towards each other respectively from two adjacent cam portions 31 are spaced, defining a gap 33 therebetween for lodging the finger portion 14 of the housing 1. That is to say, the shaft member of the actuator 3 is an incontinuous one that comprises several shaft portions 32 interrupted by the finger portions 14 of the housing 1. In some certain extent, the shaft member of such an incontinuous structure has a better capability for resisting break. Once in assembly, the finger portions 14 fitly disposed in the corresponding gaps 33 between the shaft portions 32 and the shaft portions 32 pivotably accommodated in the corresponding concave portions 210 of the pivot beams 21 respectively. The actuator 3 further has a pair of bosses 34 on both ends thereof. Accordingly, the housing 1 defines a pair of recesses 15 in both side portions thereof to accommodate the bosses 34. Assembling of the actuator 3 is performed by placing the shaft portions 32 respectively below the corresponding concave portion 210, and then installing the support members 4 into the side portions 15 of the housing 1 respectively to support the bosses 34 of the actuator 3 from downward movement and therefore to maintain engagement between the shaft portions 32 and the pivot beams 21.

Figure 3A:
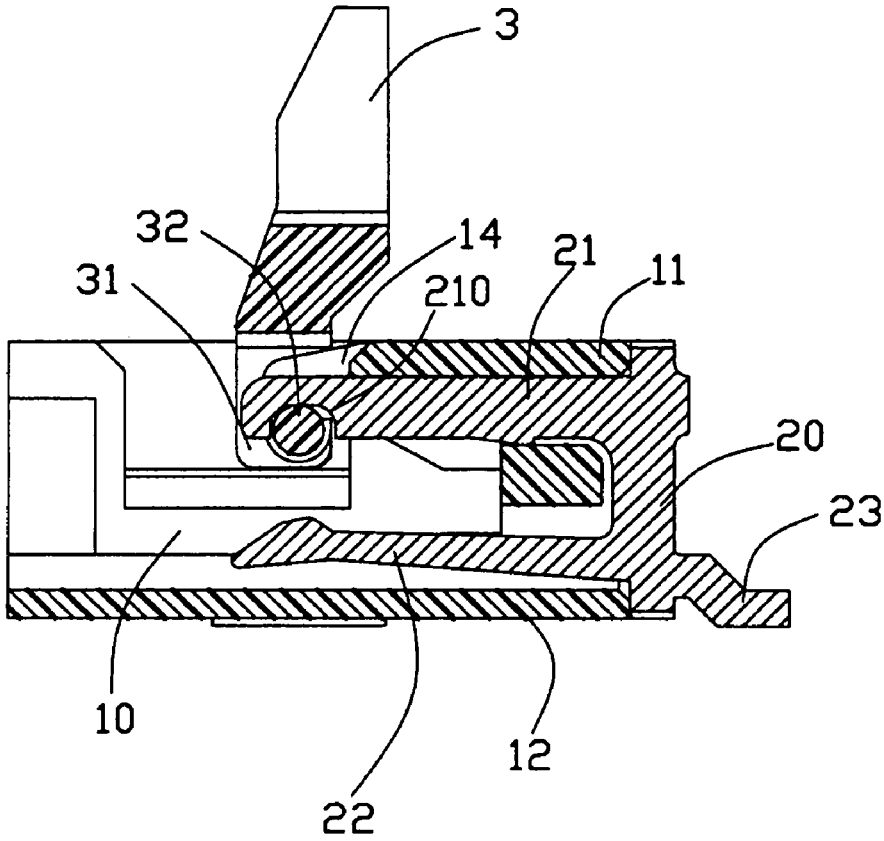
FIG. 3(A) is a cross-sectional view of FIG. 1 taken along line 3-3, wherein an actuator is placed at an open position.
Figure 3B:
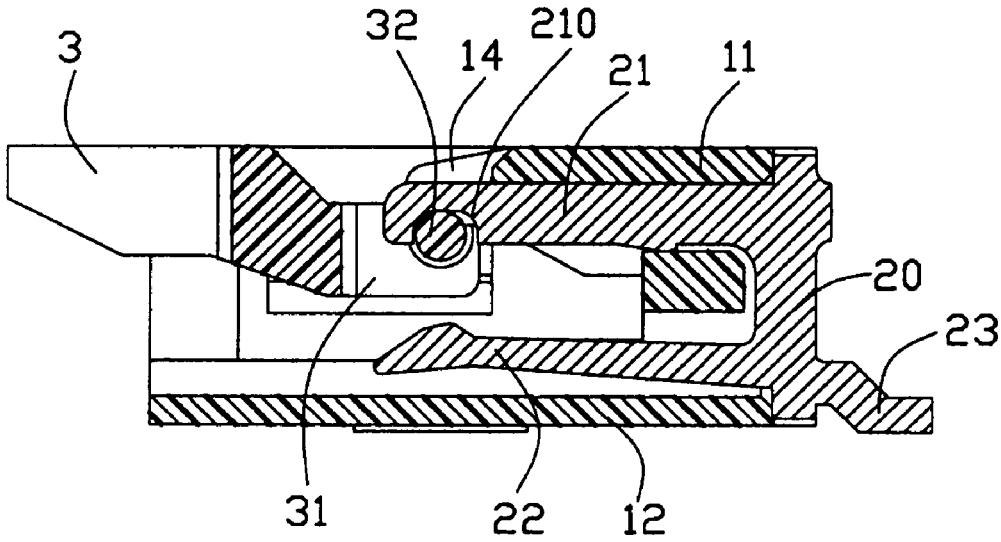
FIG. 3(B) is a cross-sectional view similar to FIG. 3(A), but wherein the actuator has been rotated to a closed position.
Figure 4:
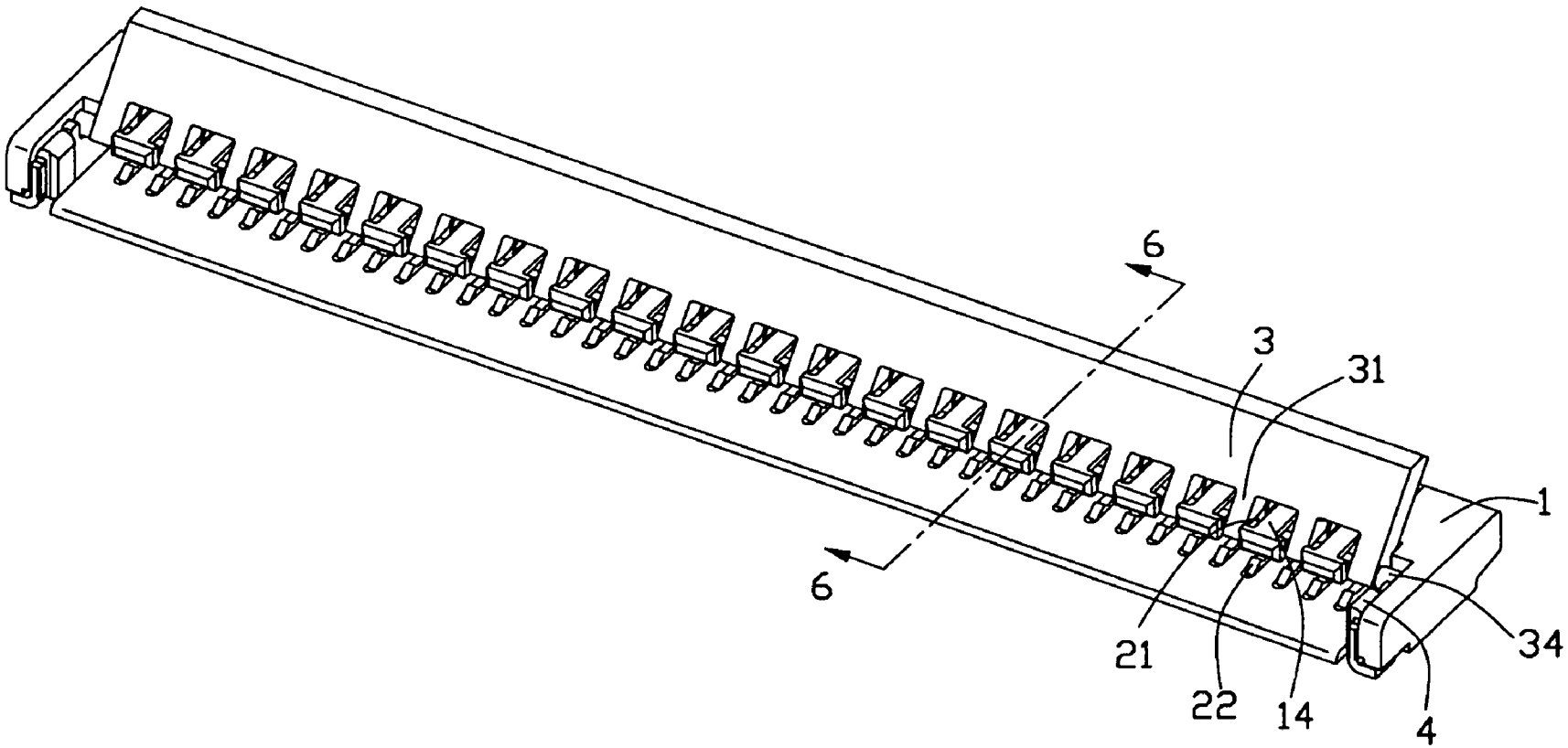
FIG. 4 is an assembled perspective view of an FPC connector in accordance with a second embodiment of the present invention.

In assembly, the actuator 3 is rotatable between an open position as shown in FIG. 3(A) where an FPC (not shown) is allowed to be inserted into the FPC insertion slot 10 and a closed position as shown in FIG. 3(B) where the FPC is urged to electrically connect with the contact beams 22 of the terminals 2 through the cam portions 32.

In order to maintain the actuator 3 at the closed position thereof, there is a retention device between the actuator 3 and the housing 1. The retention device comprises a pair of latches 36 provided by the actuator 3 and a pair of cutouts 17 provided by the housing 1, wherein the latches 36 are respectively formed beside a main plate 35 of the actuator 3 and spaced from the main plate 35, and the cutouts 17 are respectively defined below top flanges 16 extending from the side portions of the housing 1, to communicate the entrance of the FPC insertion slot 10. Each latch 36 has a protuberance 360 for engaging with the top flange 16. The latches 36 are inwardly deflectable once inwardly pushed since the latches 36 are spaced from the main plate 35. Thus, when the actuator 3 is rotated from the open position to the closed position, the protuberance 360 pushes through the top flange 16 into the cutout 17 and then remains therein. That prevents the actuator 3 from being reversely rotated and therefore maintains the actuator 3 at the closed position so as to keep the FPC being firmly connected with the contact beams 22 of the terminals 2.

Turning to FIGS. 4-8, description will be made as an FPC connector according to the second embodiment of the present invention. Similar parts are designated by like reference numbers.

The FPC connector of the second embodiment comprises an insulative housing 1, a plurality of terminals 2, an actuator 3, and a pair of support members 4 as well as the connector of the first embodiment, but has a larger length dimension than the connector of first embodiment due to more required terminals 2.

The housing 1 is provided with a plurality of terminal receiving grooves 13, which comprises an upper groove 131 defined in an upper wall 11 of the housing 1 and a lower groove 132 defined in a bottom wall 12 of the housing 1. The terminals 2 are respectively accommodated in the terminal receiving grooves 13 and therefore are arranged in side-by-side relationship with a predetermined pitch. As best shown in FIGS. 6-8, upon being installed in the housing 1, the pivot beam 21 of the terminal 2 extends within the upper groove 131 and has a top surface thereof upwardly exposed to exterior as the upper groove 131 is upwardly opened in the upper wall 11. The contact beam 22 of the terminal 2 extends within the lower groove 132 and has an upper surface thereof upwardly exposed to the FPC insertion slot and a bottom surface thereof downwardly exposed to exterior as the lower groove 132 is defined through the bottom wall 12 in the height direction thereof. Such a structure design minimizes height of the upper wall 11 and bottom wall 12 of the housing 1 and thus would reduce the whole height of the FPC connector, thereby forming a lower profile FPC connector. According to such a structure design, each terminal 2 in this embodiment further comprises a retaining protuberance 24 sideward protruding from the base portion 20 to be set in the housing 1. Thus the installed terminals 2 can be firmly fixed in the housing 1 by engagement between the retaining protuberance 24 and the housing 1 and prevented from upward or downward rotation, which may occurs during opening and closing operation of the actuator 3, since the pivot beams 21 are upwardly exposed and there is no support above the terminals 2 against upward rotation, and the contact beams 22 are downwardly exposed and there is no support below the terminals 2 against downward rotation. Additionally, this retaining protuberance 24 also prevents moments experienced by the terminal 2 from being transferred to the solder joint of the terminal 2 soldered on the printed circuit.

Figure 6A:
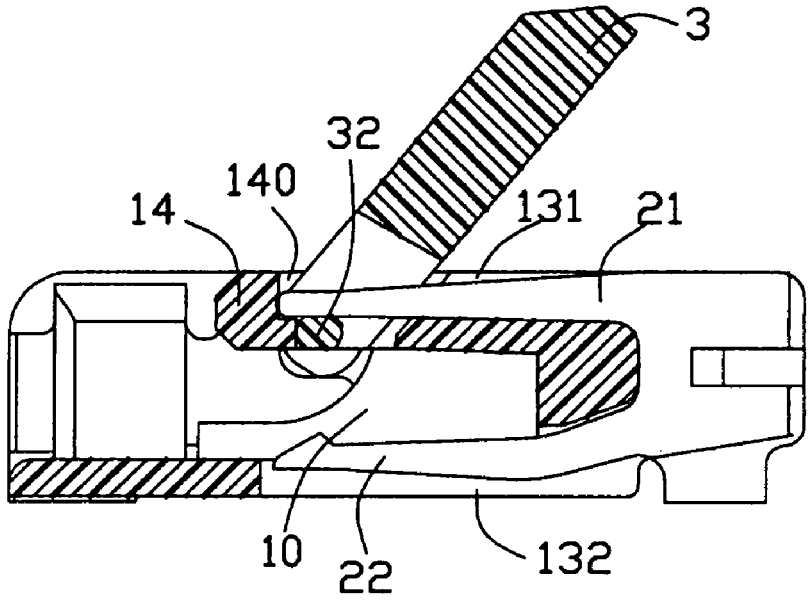
FIG. 6(A) is a cross-sectional view of FIG. 4 taken along line 6-6, wherein an actuator is placed at an open position.
Figure 6B:
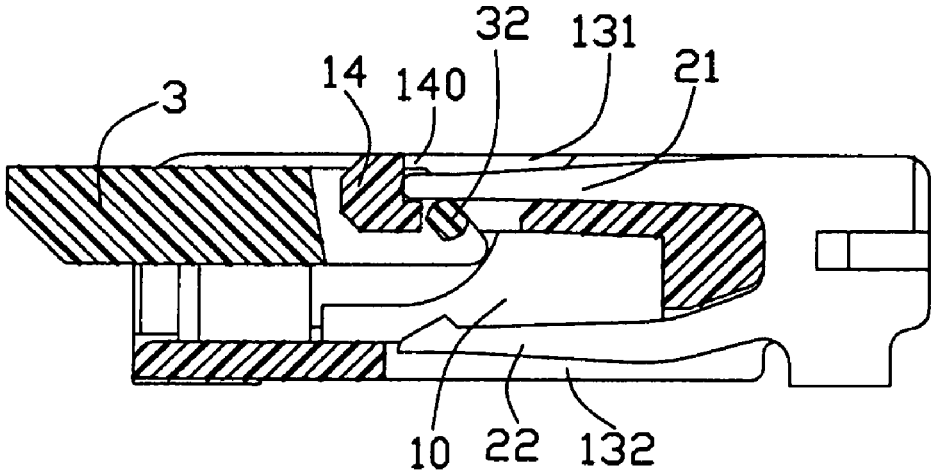
FIG. 6(B) is a cross-sectional view similar to FIG. 6(A), but wherein the actuator has been rotated to a closed position.
Figure 7:
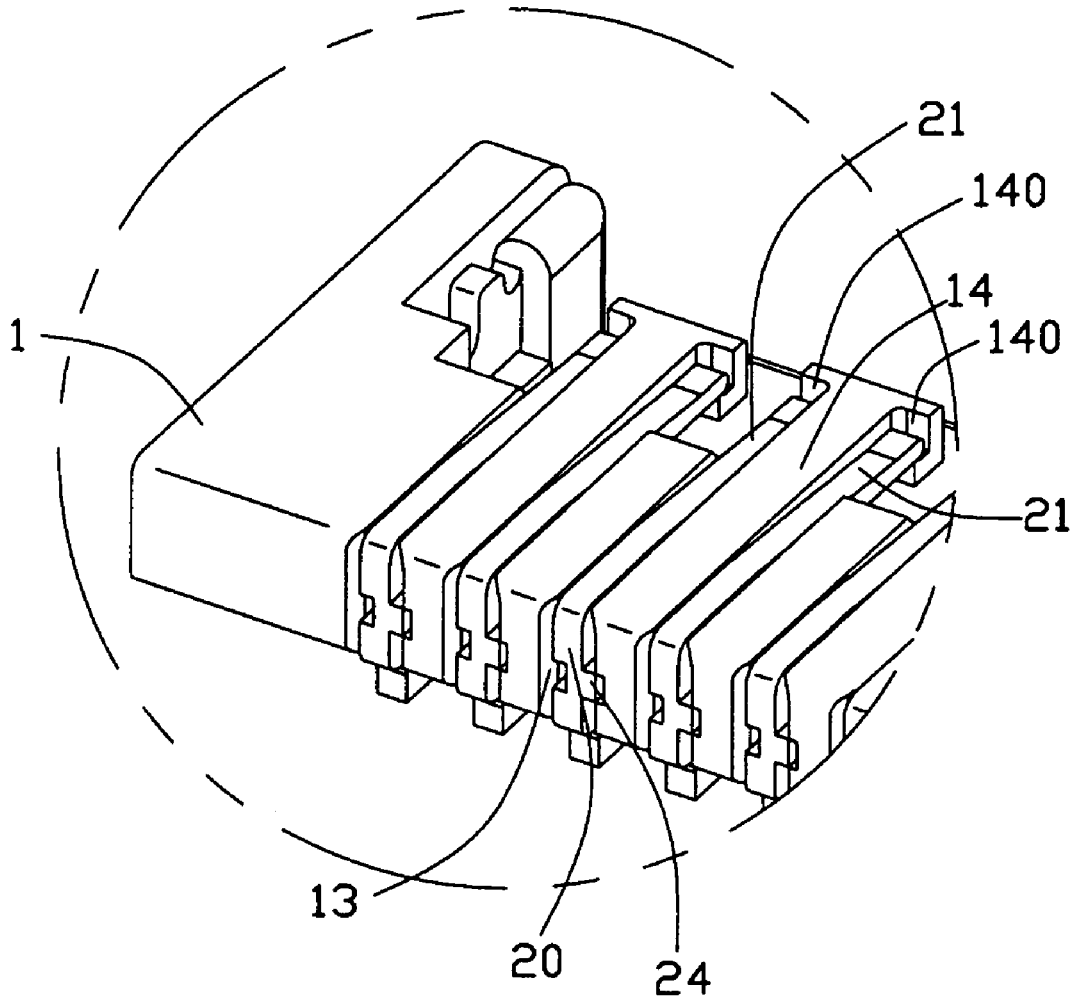
FIG. 7 is a partly magnified view of the FPC connector shown in FIG. 4, specially showing installation of terminals in a housing thereof.
Figure 8:
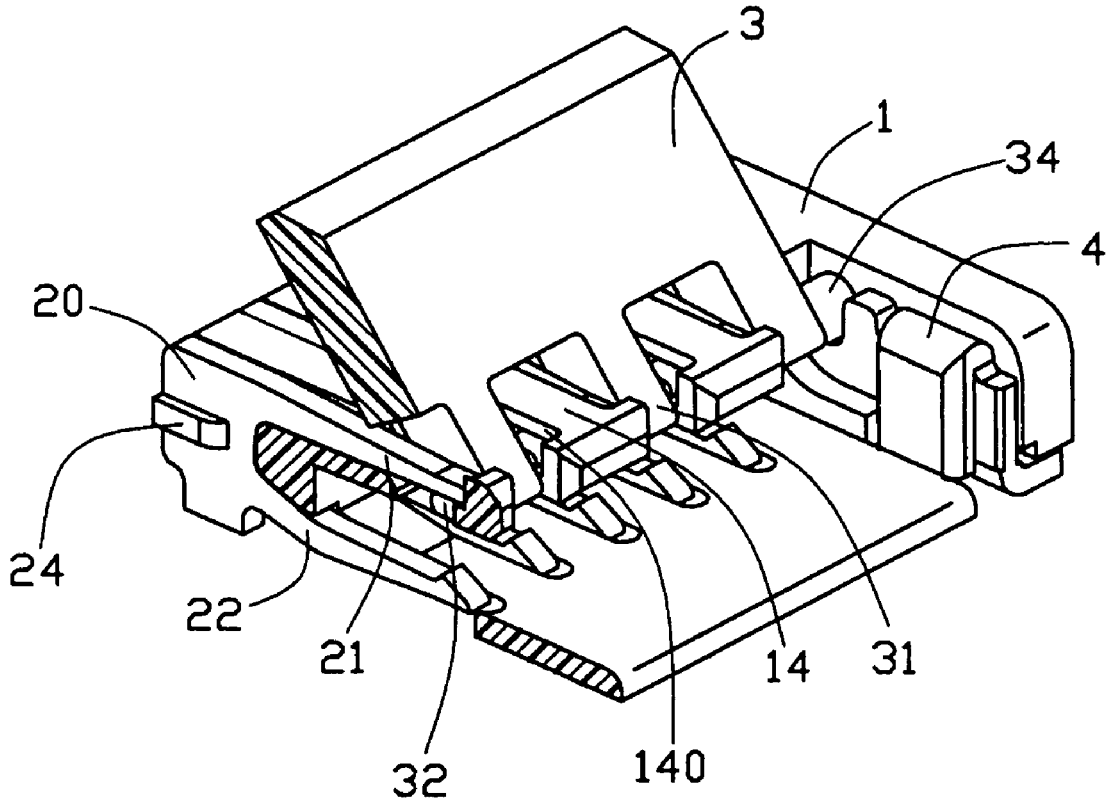
FIG. 8 is a partly cut out perspective view of the FPC connector shown in FIG. 4.

Being distinguished from the first embodiment, in this embodiment, the pivot beam 21 is formed without concave portion and yet the finger portions 14 is provided with T-shaped head which defines a pair of inwards opened recesses 140 for respectively receiving a tip of the pivot beam 21 disposed therebeside, as best shown in FIGS. 6-7. In other words, the finger portion 14 in front of the recess 140 forms a lip portion to cover the corresponding pivot beam 21. In assembly, the cam portions 31 are interposed between every other pivot beams 21 without finger portions 14 therebetween and each shaft portion 32 is supported below a corresponding pivot beam 21 from upward movement and behind a bottom portion of a corresponding recess 140 that receives the corresponding pivot beam 21 from forward movement. Thus the actuator 3 is rotatable between an open position as shown in FIG. 6(A) and a closed position as shown in FIG. 6(B).

Figure 9:
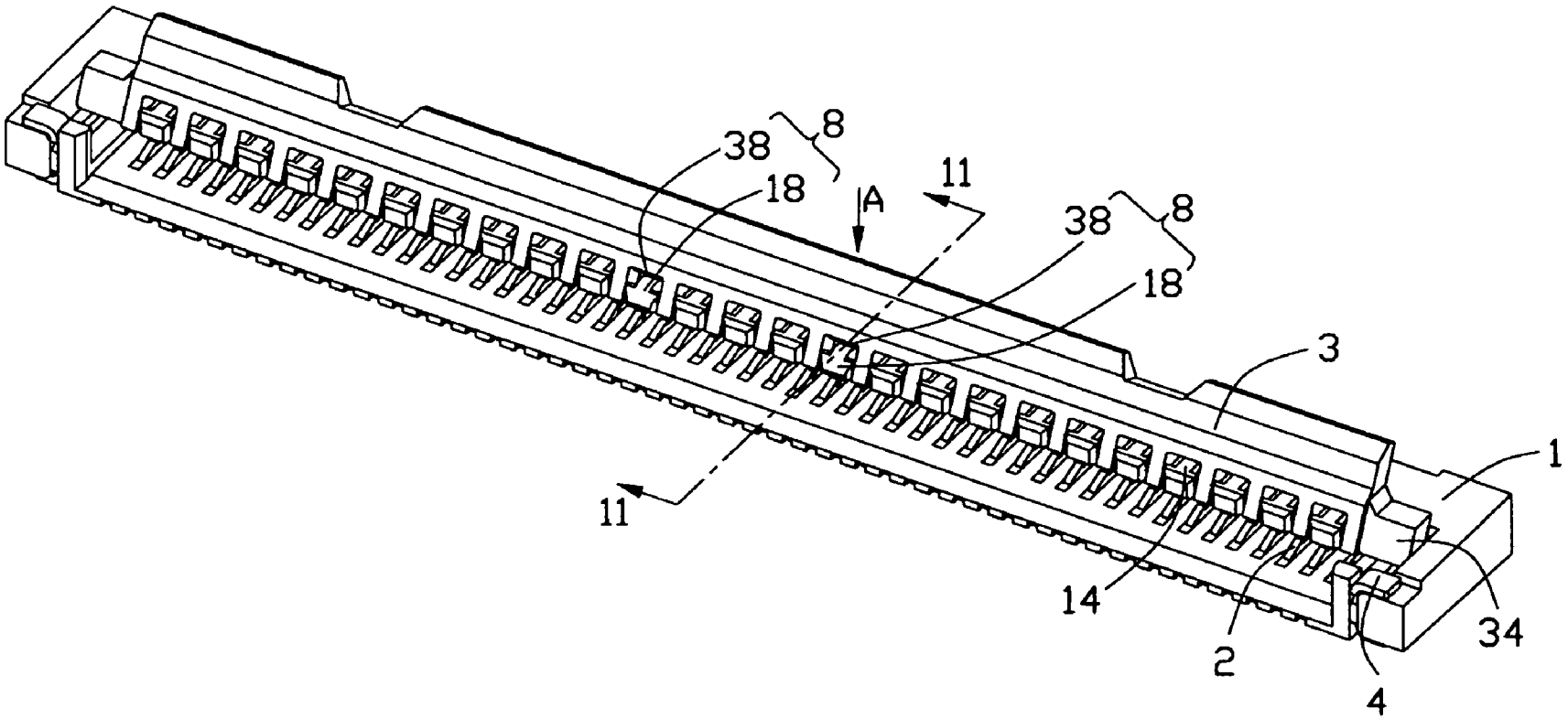
FIG. 9 is an assembled perspective view of an FPC connector in accordance with a third embodiment of the present invention.
Figure 10:
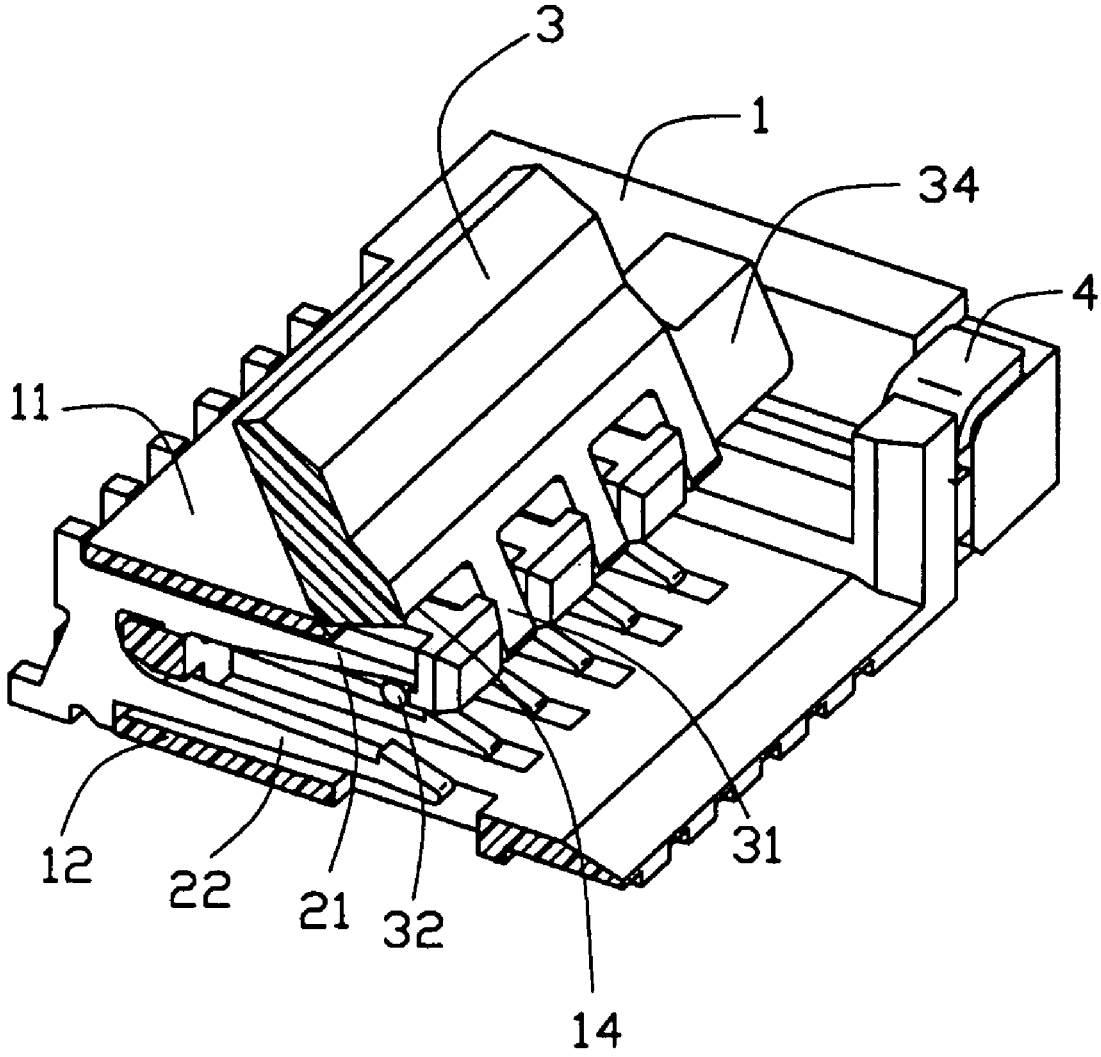
FIG. 10 is a partly cut out perspective view of the FPC connector shown in FIG. 9.
Figure 11:
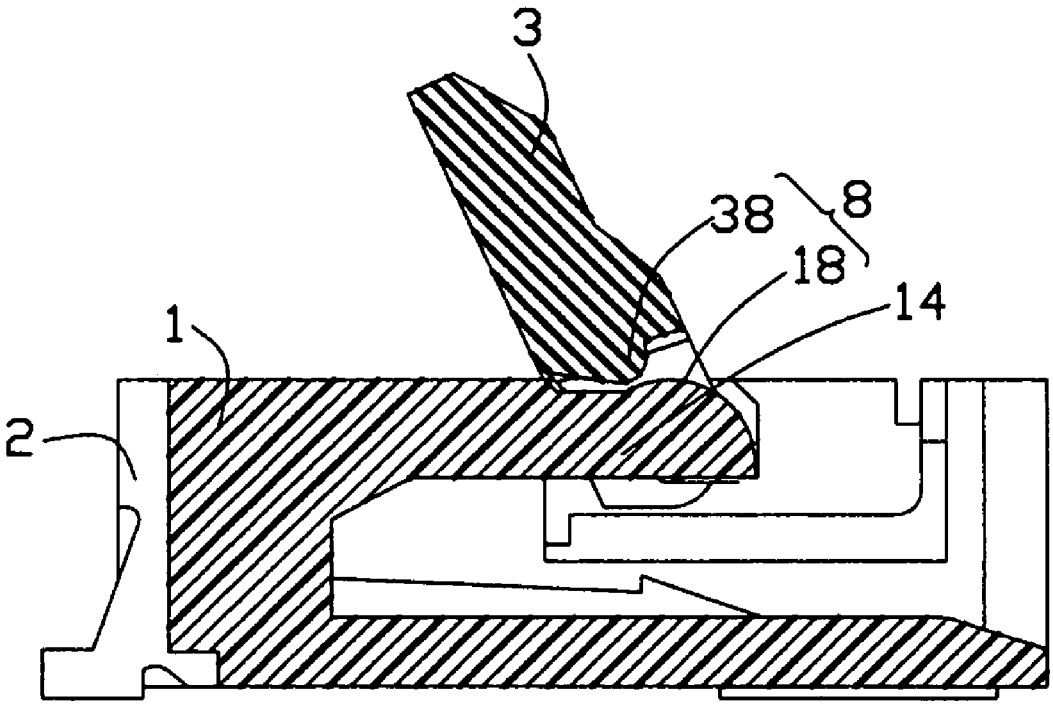
FIG. 11 is a cross-sectional view of FIG. 9 taken along line 11-11, showing a warpage prevention device of the present invention.

Turning to FIGS. 9-11, description will be made as an FPC connector according to the third embodiment of the present invention. Similar parts are designated by like reference numbers.

The FPC connector of the third embodiment has the same finger portion 14 with T-shaped head as that of the second embodiment. However, the pivot beams 21 of the terminals 2 are not upwardly exposed to exterior except the tips thereof and the contact beams 22 are not downwardly exposed to the exterior except the tips thereof, which is distinguished from the second embodiment. Accordingly, the terminal 2 in this embodiment has no need for the retaining protuberance 24 as disclosed in the second embodiment since there are supports both above the pivot beams 21 and below the contact beams 22 to prevent the terminals 2 from upward or downward rotation.

Figure 5:
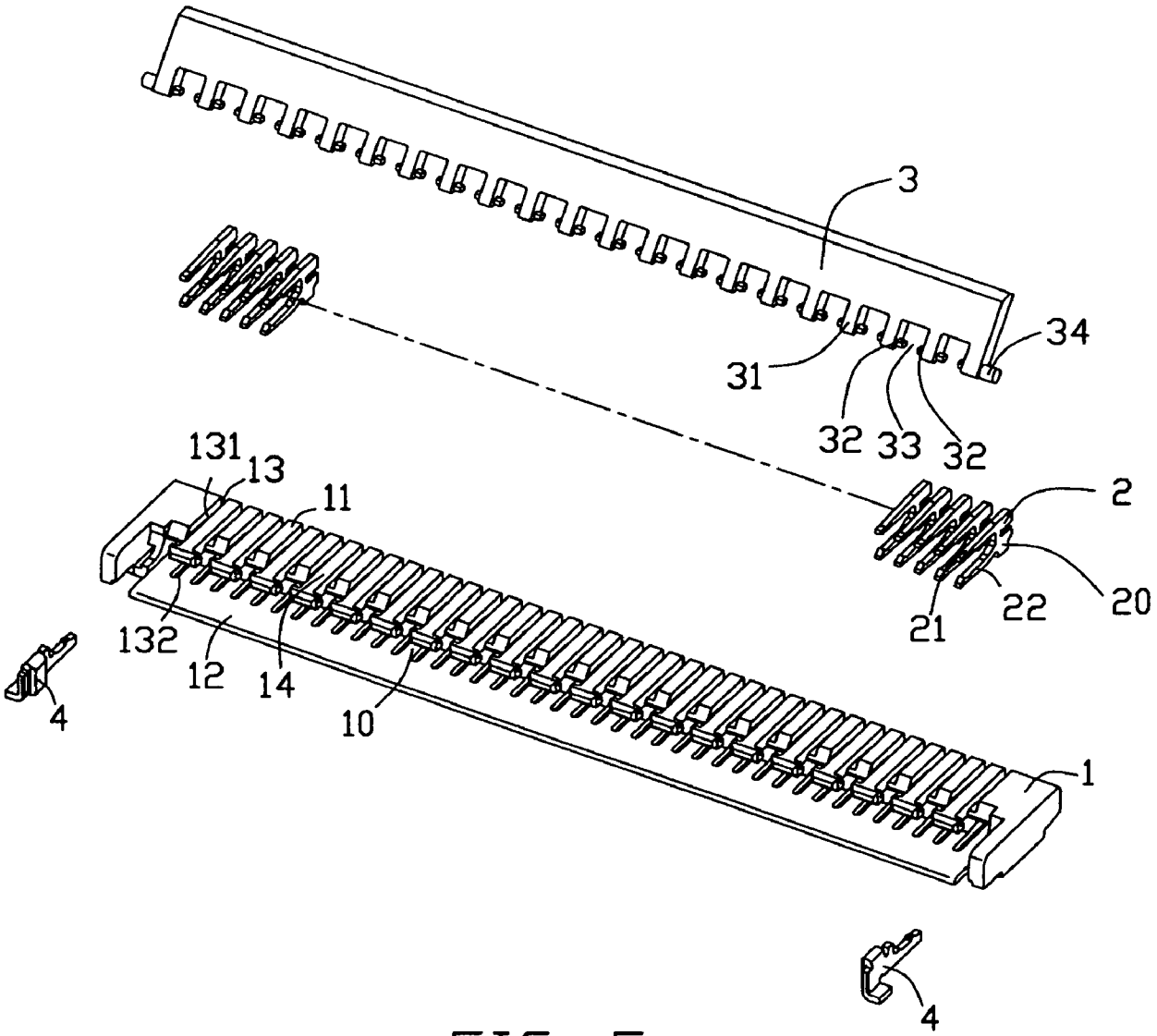
FIG. 5 is an exploded perspective view of the FPC connector shown in FIG. 4.

Above are three preferred embodiments of the present invention. Now a warpage prevention device of the present invention will be described alone hereafter. When the FPC connectors have a considerable length dimension, such as the FPC connectors in the second and third embodiment respectively as shown in FIGS. 5 and 9, the actuator 3 will accordingly be an elongated one and have a quite span along a longitudinal direction, thus a warpage is apt to occur to the actuator 3 during the molding process. In addition, if the actuator 3 is only supported by the bosses 34 at the two ends thereof and there is no other support device to hold up the middle portion of the actuator 3, when the actuator 3 is in the open position, the middle portion of the actuator 3 is apt to drop down due to the weight thereof, causing a warpage of the actuator 3 along a direction denoted as arrow A. Such warpage of the actuator 3, either occurs as a result of molding process or due to the weight thereof, will cause the middle portion of the actuator 3 to protrude towards and interfere with the FPC while the actuator 3 is in the open position. If this bad situation occurs, the FPC connector may not function with zero insertion force. In order to avoid such situation, a warpage prevention device is added to the FPC connector of the present invention. Referring to FIGS. 9 and 11, the instantiated warpage prevention device 8 comprises a convex guide surface 18 provided on the T-shaped head of the finger portion 14 and a cam follower 38 provided on the actuator 3. The cam follower 38 could be supported upon the guide surface 18 to prevent the middle portion of the actuator 3 from interfering with the FPC when the actuator 3 is in the open position, and then could slide on the guide surface 18 while the actuator 3 is rotated between the open position and the closed position to guide the rotation movement of the actuator 3. There would be more than one such warpage prevention devices 8, and such warpage prevention devices 8 would be set in any proper position as the guide surface 18 would be provided on any one of the finger portions 14 and the cam follower 38 would be provided on any corresponding position of the actuator 3.

Figure 12:
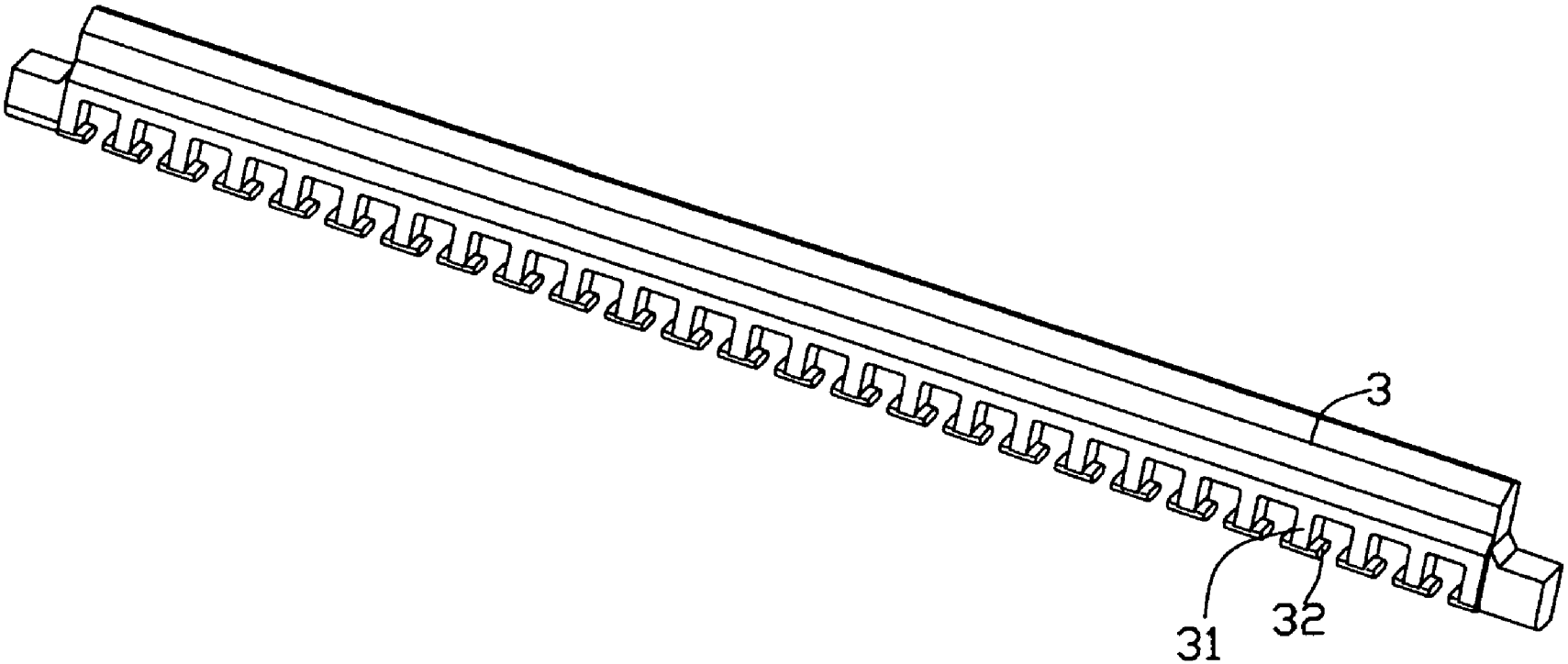
FIG. 12 is a view showing a second kind of actuator of the present invention with an oval cross section.

However, the disclosure is illustrative only, changes may be made in detail, especially in matter of shape, size, and arrangement of parts within the principles of the invention. For example, the shafts 32 of the actuator 3 of the present invention can be formed into a shape with an oval cross section and provided with function for pushing the FPC as well as the cam portion 31, as shown in FIG. 12.

What is claimed is:

1. An electrical connector for connecting a sheet-like member, comprising:

a housing defining an insertion slot for receiving the sheet-like member;

a plurality of terminals arranged in the housing in parallel relationship with a predetermined pitch, each of the terminals having a contact beam extending into the insertion slot and a pivot beam extending substantially parallel to the contact beam; and an actuator rotatably provided for establishing an electrical connection between the sheet-like member and the contact beams, said actuator providing cam portions each interposed between every other said pivot beam, each of the cam portions providing shaft portions respectively adapted for pivotably engaging with the pivot beams disposed therebeside, the shaft portions extending towards each other respectively from two adjacent cam portions being spaced and defining a gap therebetween, wherein the housing provides finger portions extending forwards into the insertion slot and interposed between every other said pivot beams without said cam portion interposed therebetween and the finger portion further extends into the gap between the shaft portions.

2. The electrical connector as described in claim 1, wherein each of the shaft portions has a substantially round cross section, and the cam portions engage with the sheet-like member whereas the shaft portions do not engage with the sheet-like member.

3. The electrical connector as described in claim 1, wherein each of the shaft portions has a substantially oval cross section, and both the cam portions and the shaft portions engage with the sheet-like member.

4. The electrical connector as described in claim 1, wherein the pivot beams extending into the insertion slot and each defines a concave portion at a tip end portion thereof, and the shaft portion is pivotably accommodated in the concave portion and prevented from forward movement.

5. The electrical connector as described in claim 1, wherein at least one of the finger portions defines a convex top surface, and the actuator correspondingly provides a cam follower slideable on the convex top surface.

6. The electrical connector as described in claim 1, wherein each of the finger portions is formed with an enlarged head, and the shaft member is supported behind said enlarged head from forward movement and below the pivot beam from upward movement.

7. The electrical connector as described in claim 6, wherein the enlarged head defines a pair of recesses for respectively receiving tips of said pivot beams disposed therebeside.

8. The electrical connector as described in claim 6, wherein the pivot beam has a top surface upwardly exposed to exterior but not shielded by the housing and the contact beam has a bottom surface downwardly exposed to exterior but not shielded by the housing.

9. The electrical connector as described in claim 8, wherein the terminal has a retaining protuberance sideward protruding therefrom adapted to be set in the housing so as to prevent the terminal from upward or downward rotation.

10. The electrical connector as described in claim 4, wherein the concave portion is on a lower edge of the tip end portion of the pivot beam.

11. The electrical connector as described in claim 1, wherein the actuator is provide with a pair of deflectable latches and the housing is provided a pair of retention recesses, the latch formed with a protuberance retainable in the retention recess.

12. An electrical connector comprising:

an insulative housing defining an insertion slot along a longitudinal direction for receiving a sheet-like electronic member;

a plurality of terminals disposed in the housing and including a plurality of contact beams on one side of the insertion slot for engagement with the corresponding sheet-like electronic member;

a plurality of pivot beams located on another side of the insertion slot opposite to said contact beams; and an actuator rotatably mounted to the housing and defining a plurality of spaced cam portions for pressing the sheet-like electronic member, each of said cam portions being equipped with a pair of the shaft portions respectively extending oppositely from two opposite sides thereof;

each cam portion interposed between two corresponding neighboring pivot beams, and every two neighboring shaft portions extending towards each other respectively from two adjacent cam portions and being spaced from each other with therebetween a gap without any portions of said actuator disposed in said gap, wherein said every two neighboring shaft portions engage said two corresponding pivot beams, respectively.

13. The electrical connector as described in claim 12, wherein the housing provides finger portions extending into the insertion slot and interposed between every said corresponding pivot beams without said cam portion interposed therebetween.

14. The electrical connector as described in claim 13, wherein the finger portion further extends into the gap between the shaft portions.

15. An electrical connector for connecting a sheet-like member, comprising:

a housing defining an insertion slot for receiving the sheet-like member;

a plurality of terminals arranged in the housing in parallel relationship with a predetermined pitch, each of the terminals having a contact beam extending into the insertion slot and a pivot beam extending substantially parallel to the contact beam; and an actuator rotatably provided for establishing an electrical connection between the sheet-like member and the contact beams, said actuator providing cam portions each interposed between every other said pivot beam, each of the cam portions providing shaft portions respectively adapted for pivotably engaging with the pivot beams disposed therebeside, the shaft portions extending towards each other respectively from two adjacent cam portions being spaced and defining a gap therebetween, wherein the housing provides finger portions extending forwards into the insertion slot and interposed between every other side pivot beams without said cam portion interposed therebetween;

wherein each of the finger portions is formed with an enlarged head, and the shaft member is supported behind said enlarged head from forward movement and below the pivot beam from upward movement.

16. The electrical connector as described in claim 15, wherein the enlarged head defines a pair of recesses for respectively receiving tips of said pivot beams disposed therebeside.

17. The electrical connector as described in claim 15, wherein the pivot beam has a top surface upwardly exposed to exterior but not shielded by the housing and the contact beam has a bottom surface downwardly exposed to exterior but not shielded by the housing.

18. The electrical connector as described in claim 17, wherein the terminal has a retaining protuberance sideward protruding therefrom adapted to be set in the housing so as to prevent the terminal from upward or downward rotation.

* * * * *